United States Patent [19]

Sullivan et al.

[11] Patent Number: 4,974,732

[45] Date of Patent: Dec. 4, 1990

[54] SEALED POUCH HAVING TEAR-OPEN SPOUT

[75] Inventors: Timothy R. Sullivan; Karl A. Kohler; Thomas J. Szymczak, all of Racine, Wis.

[73] Assignee: S. C. Johnson & Son, Inc., Racine, Wis.

[21] Appl. No.: 565,875

[22] Filed: Aug. 9, 1990

Related U.S. Application Data

[63] Continuation of Ser. No. 474,414, Feb. 2, 1990, abandoned.

[51] Int. Cl.[5] ..... B65D 3/26

[52] U.S. Cl. ..... 206/610; 206/484; 206/632; 222/541; 383/908

[58] Field of Search ..... 206/484, 621, 621.3, 206/621.4, 621.5, 621.7, 634, 601, 610, 632; 222/541, 566, 569, 572; 383/908

[56] References Cited

U.S. PATENT DOCUMENTS

| | | | |
|---|---|---|---|
| 2,248,266 | 7/1941 | Abrams | 206/484 |
| 2,707,581 | 5/1955 | Kaplan et al. | 222/541 |
| 2,791,324 | 5/1957 | Knoop et al. | 206/484 |
| 2,923,404 | 2/1960 | Adell . | |
| 2,956,710 | 10/1960 | O'Connor | 222/541 |
| 3,095,088 | 6/1963 | Blaikie et al. | 206/610 |
| 3,144,976 | 8/1964 | Freshour | 206/484 |
| 3,146,912 | 9/1964 | Twersky | 206/634 |
| 3,155,282 | 11/1964 | Leblanc | 222/541 |
| 3,179,327 | 4/1965 | Burton et al. . | |
| 3,300,099 | 1/1967 | Marona | 222/566 |
| 3,397,835 | 8/1968 | Henning | 206/610 |
| 3,397,835 | 8/1968 | Henning . | |
| 3,412,918 | 11/1968 | Sherman | 383/908 |
| 3,510,054 | 5/1970 | Sanni et al. . | |
| 3,565,328 | 2/1971 | Hudson . | |
| 3,579,397 | 5/1971 | Schwarzkopf . | |
| 3,608,815 | 9/1971 | Bunch . | |
| 3,616,990 | 11/1971 | Powell . | |
| 4,007,838 | 2/1977 | Awad | 206/484 |
| 4,250,999 | 2/1981 | Milvik . | |
| 4,491,224 | 1/1985 | Horvath . | |
| 4,519,499 | 5/1985 | Stone et al. . | |
| 4,720,011 | 1/1988 | Canamero . | |
| 4,834,245 | 5/1989 | Ohga et al. . | |
| 4,838,429 | 6/1989 | Fabisiewicz et al. . | |
| 4,872,556 | 10/1989 | Farmer | 206/632 |

FOREIGN PATENT DOCUMENTS

| | | | |
|---|---|---|---|
| 109965 | 6/1984 | European Pat. Off. | 206/610 |
| 1047236 | 11/1966 | United Kingdom | 222/541 |
| 2180214 | 3/1987 | United Kingdom | 222/541 |

*Primary Examiner*—David T. Fidei

[57] ABSTRACT

An improvement in a sealed pouch made of molecularly-orientable polymeric film that is sealed along peripheral edge margins is disclosed. The pouch defines a sealed cavity for containment of a fluid. The pouch also defines a sealed fluid-discharge spout that is in fluid communication with the fluid cavity. The pouch further defines a seam disposed between the fluid cavity and the spout. The improvement comprises at least three essential features. One such feature is that a portion of the polymeric film which defines a fluid-discharge end of the spout is molecularly-oriented in a preselected direction. Another such feature is that a portion of the seam defines a slit disposed transverse to the preselected direction. Still another feature is that a portion of the sealed pouch peripheral edge margin in the vicinity of the fluid-discharge end of the spout defines a tear-initiating notch oriented in the preselected direction.

4 Claims, 3 Drawing Sheets

SEALED POUCH HAVING TEAR-OPEN SPOUT

This is a continuation of co-pending application Ser. No. 07/474,414 filed on Feb. 2, 1990, now abandoned.

TECHNICAL FIELD

Our invention relates, in general, to sealed pouches made of molecularly-orientable polymeric film that is sealed along peripheral edge margins.

BACKGROUND ART

Plastic film of, for example, polyethylene or polypropylene is virtually impossible to tear directly along a straight or other regular line. This is due to the fact that two forces, when applied in opposite directions in shear or tension over an area of such a film or thin sheet, can cause the plastic film material to deform and stretch plastically until its elastic limit is passed, whereupon a tear or separation starts. Such a tear can begin anywhere in the deformed, stretched area—which is usually at the weakest point produced by the above-described thickness reduction—and will not, in general, run normal to the tearing forces being applied. Thus, even with evenly and carefully applied forces, it is not likely that a person will be able to tear a plastic film along a preselected straight or other regular line due to the stretchability of the film.

As a result of this, in order to open a plastic pouch, it is often necessary to employ a sharp tool or other instrument. The need for a separate cutting tool is obviously bothersome, and often such tools are not available.

One solution to the above problem has been to perforate or score a prescribed portion of the pouch or film. This allows for reasonably regular tearing of the plastic film material, but the film itself is weakened. Further, perforations and the like tend to weaken the desired seal, can thus cause leakage in a pouch containing a fluid, and may thus limit the practical utility of the pouch.

In a sealed plastic pouch for containment of a fluid and having a spout for discharge of such a fluid, it would be desirable that such spout be readily openable without the use of tools or the need for scoring the plastic material.

SUMMARY DISCLOSURE OF INVENTION

Accordingly, our invention, which is directed to an improvement in a sealed pouch, can be summarized as follows. The sealed pouch is made of a molecularly-orientable polymeric film that is sealed along peripheral edge margins. The pouch defines a sealed cavity for containment of a fluid. The pouch also defines a sealed fluid-discharge spout that is in fluid communication with the fluid cavity. The pouch further defines a seam disposed between the fluid cavity and the spout.

The improvement comprises at least three essential features. One such feature is that a portion of the polymeric film which defines a fluid-discharge end of the spout is molecularly-oriented in a preselected direction. Another such feature is that a portion of the seam defines a slit disposed transverse to the preselected direction. Still another feature is that a portion of the sealed pouch peripheral edge margin in the vicinity of the fluid-discharge end of the spout defines a tear-initiating notch oriented along the preselected direction.

The foregoing as well as other features and advantages of our invention will become more readily understood by those skilled in the art after reading the best mode for carrying out the invention, discussed in detail hereinbelow, together with reference to the drawing figures which we shall now briefly mention.

BRIEF DESCRIPTION OF THE DRAWINGS

Throughout the drawings, like reference numerals refer to like parts.

BEST MODE FOR CARRYING OUT THE INVENTION

Figure 1:
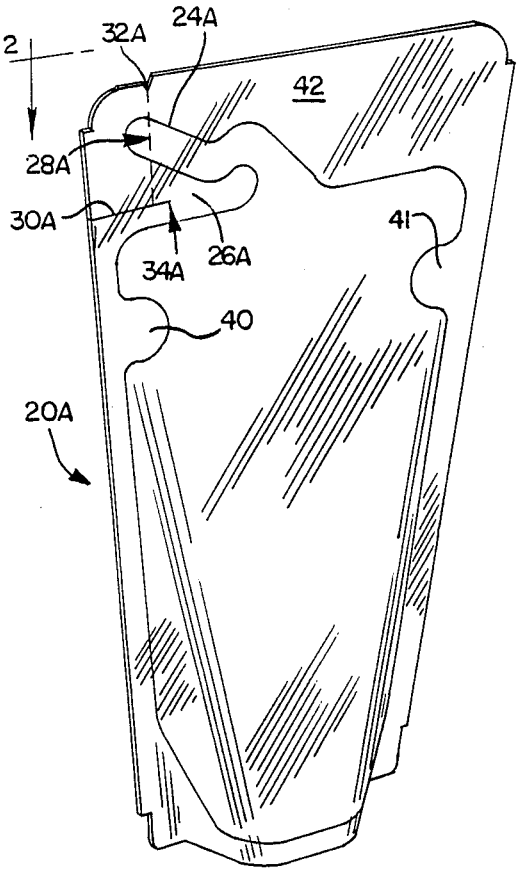
FIG. 1 is a perspective view of one embodiment of our present invention.

While our invention is susceptible to embodiment in various forms, there is shown in the above-mentioned drawings and hereinafter described in detail several presently preferred embodiments of our invention, with the understanding that the present disclosure is to be considered as merely an exemplification of our invention without limitation to the specific embodiments illustrated.

As those skilled in the art well know, edge margins of flexible plastic pouches can be joined continuously utilizing such sealing methods as heat-and-pressure, radio-frequency welding, induction heating, solvent joining, or an adhesive. See, for example, U.S. Pat. No. 4,838,429 to Fabisiewicz et al.

Referring now to the drawings and initially to FIG. 1, our improvement in a sealed container or pouch 20A will be discussed in detail.

The sealed pouch 20A is made of a molecularly-orientable, flexible polymeric film that is sealed along peripheral edge margins.

It is well-known to those skilled in the art that various thermoplastic sheet or film materials, typically used in making flexible pouches or containers, whether blown, rolled, cast, or die-extruded, are molecularly directionally orientable to some degree. For example, certain thermoplastic sheet or film materials can be intentionally oriented by stretching in a predetermined direction. See, e.g., U.S. Pat. No. 4,838,429 to Fabisiewicz et al. In this regard, well-known molecularly-orientable materials include polypropylene, polyethylene, and polystyrene. See, e.g., U.S. Pat. No. 3,608,815 to Bunch.

The pouch 20A defines a sealed cavity 22A for containment of a fluid "F". The pouch 20A also defines a sealed fluid-discharge spout 24A that is in fluid communication with the fluid cavity 22A.

Figure 2:
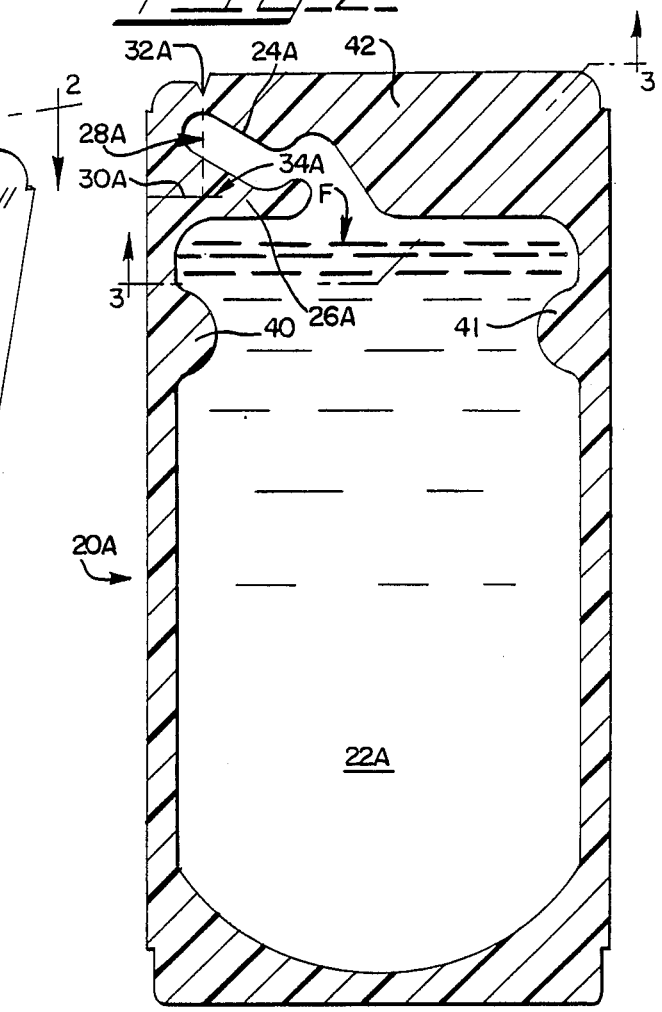
FIG. 2 is a sectional view, taken along the plane 2—2 in FIG. 1, and slightly enlarged relative to FIG. 1.
Figure 3:
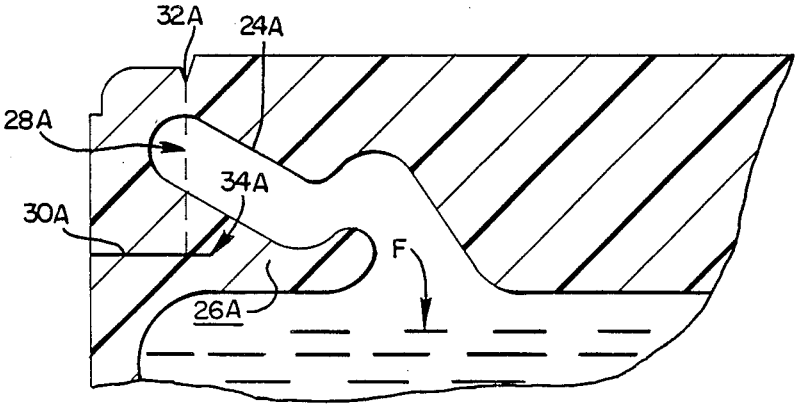
FIG. 3 is a fragmented sectional view, taken along the lines 3—3 in FIG. 2 and on an enlarged scale.

The sealed spout 24A can be serpentine as shown in FIGS. 1 through 3; or, in the alternative, either a relatively straight, sealed spout 24B disposed at an acute angle relative to cavity 22B (FIG. 4) or an elongated, sealed spout 24C having inwardly-disposed spout indents 25 (FIGS. 6–8) would be suitable for purposes of our present invention. The pouch 20A further defines a sealed seam 26A disposed between the fluid cavity 22A and the spout 24A.

The improvement comprises at least three essential features.

One such feature is that a portion 28A of the polymeric film which defines a fluid-discharge end of the spout 24A is molecularly-oriented in a preselected direction. Dashed lines are shown in FIGS. 1–3 (at portion 28A), in FIG. 4 (at portion 28B), and in FIGS. 6–8 (at portion 28C), for purposes of illustrating our preferred, preselected direction of molecular orientation in the polymeric film of the pouch of our present invention. Also, the polymeric film material that we prefer to use, for purposes of achieving this feature or aspect of our invention, is either molecularly-orientable polyethylene or polypropylene. Further, film thickness is a matter of design choice, in view of factors such as economic considerations and fluids that are to be contained, as is well known to those skilled in the art.

Figure 4:
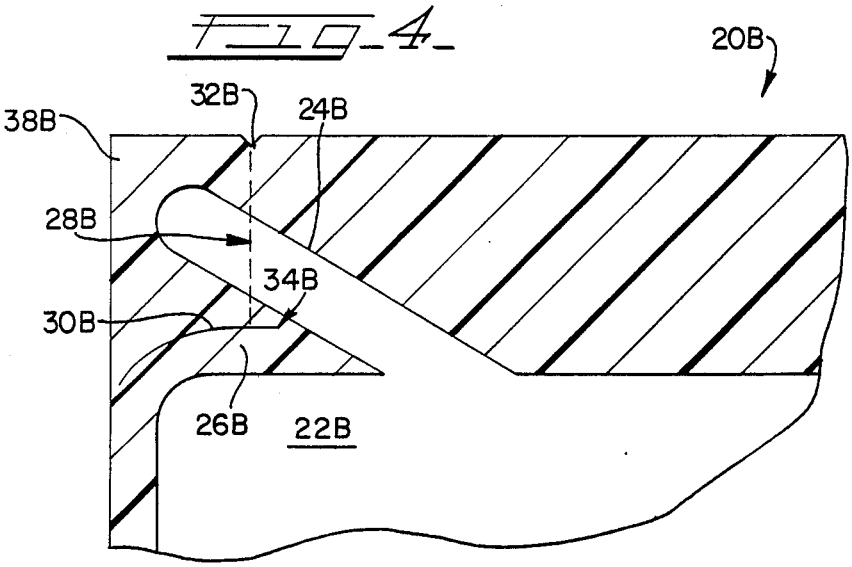
FIG. 4 is a fragmented sectional view of another embodiment of our present invention, illustrating the tear-open spout.

Another such feature of our improved pouch is that a portion of the seam 26A defines a slit 30A, which completely penetrates the film material and which is disposed transverse to the preselected direction of molecular orientation of the polymeric film, such direction of molecular orientation being illustrated by portion 28A at the discharge end of sealed spout 24A. The slit 30A can be straight, as shown in FIGS. 1 through 3; or the slit 30B can be arcuate, as shown in FIG. 4. An elongated slit 30C, shown in FIGS. 6 through 8 and further discussed hereinbelow, is still another embodiment.

Figure 5:
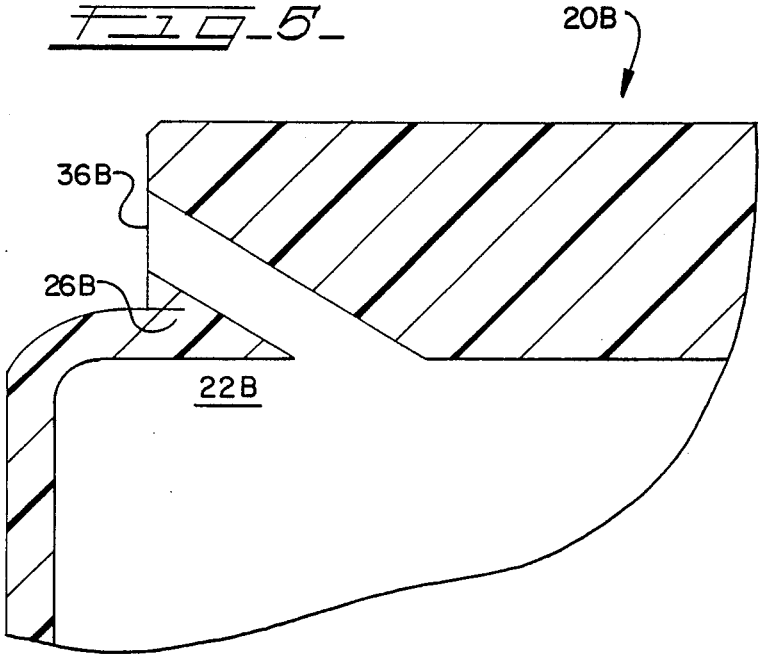
FIG. 5 is a fragmented sectional view, similar to FIG. 4, but illustrating the now torn-open spout.

Still another feature of the improved pouch of our present invention is that a portion of the sealed pouch peripheral edge margin in the vicinity of the fluid-discharge end of sealed spout 24A defines a tear-initiating notch 32A. The notch 32A is located in the vicinity of that portion 28A of the polymeric film which defines the fluid-discharge end of sealed spout 24A and is oriented in the direction of molecular orientation of the polymeric film. As a result, after grasping sealed edge margins on opposite sides of the notch with the fingers of both hands, a user is readily able to tear the pouch edge margin, from the notch to the slit. Because the orientation of the slit is transverse to the direction of molecular orientation in the polymeric film, the tear thus always terminates at the slit by our design. One end 34A of the slit 30A preferably extends so far inwardly into the seam 26A as to effectively terminate any tear initiating at notch 32A. A like arrangement is shown in FIG. 4 relative to notch 32B, slit 30B, slit terminal end 34B, and seam 26B. Further, as is shown in FIG. 1, the remainder of slit 30A can totally sever an edge margin of pouch 20A, or as shown in FIG. 4 can terminate in the edge margin just short of severing the same. Preferably, the amount of edge margin thus left unsevered is minimal, enabling the corner 38B (FIG. 4) of the pouch 20B to be readily removed from the remainder of the pouch edge margin without causing undesired fluid leakage from the cavity 22B of the pouch 20B. Thus, in operation, propagation of the tear from the notch 32B to the slit 30B, and tearing away the removable corner 38B (FIG. 4) from the edge margin of the pouch 20B, results in a pouch 20B having a spout which, in turn, has an open discharge end 36B (FIG. 5).

Reference is next invited back to FIGS. 1 and 2 for purposes of discussing yet another feature of our present invention. Such an illustrated embodiment of our pouch 20A includes cavity indents 40 and 41 defined by the pouch edge margins and disposed inwardly into the cavity 22A. The cavity indents 40 and 41 are so located relative to the closed serpentine spout 24A, defined by upper edge margin 42 of pouch 20A, as to enable a user to force fluid from cavity 22A into serpentine spout 24A by exerting pressure on the fluid contained in pouch 20A, via the pouch sidewalls, with minimal deformation occurring in upper margin 42. Those skilled in the art can appreciate that deformation of upper margin 42 would tend to restrict flow of fluid through serpentine spout 24A.

The indents 40 and 41 (FIGS. 1 and 2) are not an essential feature of our present invention, although inclusion of such are presently preferred by us. Accordingly, as those skilled in the art can well appreciate, certain pouches incorporating the three above-discussed essential features of our invention, but not including the indents 40 and/or 41, can be manufactured if desired.

Figure 6:
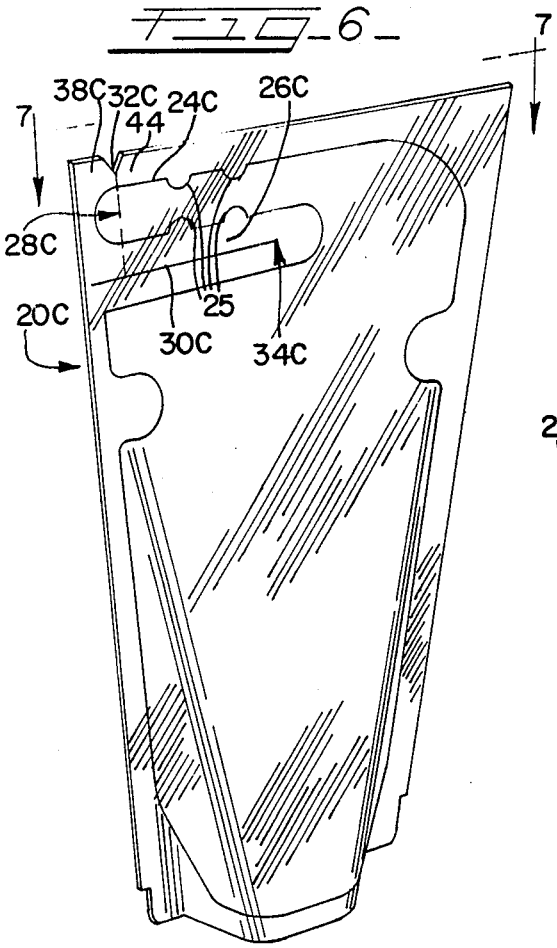
FIG. 6 is a perspective view of still another embodiment of our present invention.
Figure 7:
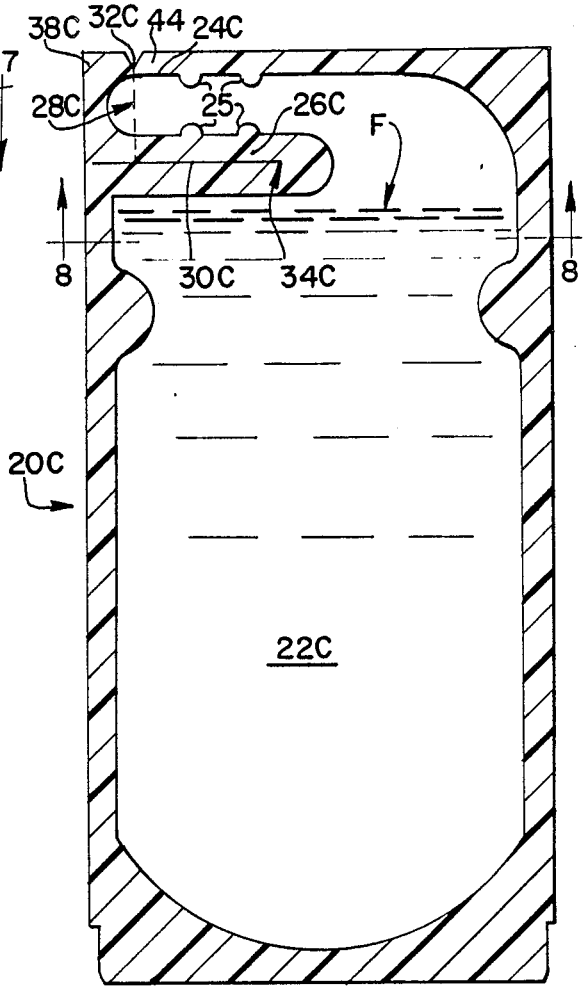
FIG. 7 is a sectional view, taken along the plane 7—7 in FIG. 6, and slightly enlarged relative to FIG. 6.
Figure 8:
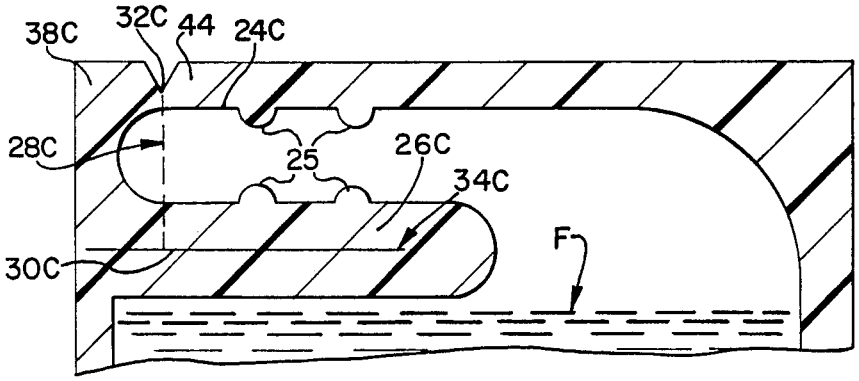
FIG. 8 is a fragmented sectional view, generally taken along the line 8—8 in FIG. 7 and on an enlarged scale.

Reference is further invited to FIGS. 6 through 8 for purposes of discussing still another feature of our present invention. As is illustrated, the spout 24C and seam 26C can each be elongated; and the slit 30C can be elongated and so inwardly disposed relative to the seam 26C as to locate the seam inner end 34C at a point that is effective for forming an upper edge margin flap 44 which defines the elongated spout 24C. After the corner 38C is removed from pouch 20C, by initiating a tear in the spout end portion 28C from the notch 32C to the slit 30C in the manner described above, the flexible nature of the polymeric material of the pouch 20C enables a user to flex the flap 44 out of a plane defined by the remainder of the sealed upper edge margin of the pouch 20C, to thus direct the flow of fluid through elongated spout 24C if desired.

The spout indents 25, mentioned above, if present, further control the flow of fluid through elongated spout 24C. The spout indents 25, like the elongated spout 24C, are defined by the sealed, upper edge margin of pouch 20C. As is illustrated in FIGS. 6 through 8, the spout indents 25 are located on opposite inner sidewalls of elongated spout 24C. One purpose of the spout indents 25 is to provide a means for controlling fluid discharge rate, within predetermined limits, when a user is intentionally forcing fluid through the elongated spout 24C. Another purpose of the spout indents 25 is to minimize fluid discharge rate when a user is unintentionally forcing fluid through the elongated spout 24C, as happens when an open pouch is passed from one user to another. Still another purpose of the spout indents 25 is to restrict flow of fluid through the elongated spout 24C when the pouch is not in use, as happens, for example, when the pouch is unintentionally left on its side. Achieving these various purposes will depend for example on the viscosity and surface tension of the contained fluid, the axial and transverse dimensions of the elongated spout 24C, the relative number of spout indents 25 disposed along the axial direction of elongated spout 24C, and the spacing of oppositely disposed spout indents 25 with respect to the spout transverse direction.

What has been illustrated and described herein is an improvement in a sealed pouch made of molecularly-orientable polymeric film. While the improved pouch of the invention has been illustrated and described with reference to several preferred embodiments, our invention is not limited thereto. On the contrary, alternatives, changes or modifications will become apparent to those skilled in the art upon reading the foregoing description. For example, while our pouch is shown as including an upstanding base (FIGS. 1 and 6), a flat-bottomed pouch of the type disclosed in U.S. Pat. No. 3,510,054 to Sanni et al. would be an obvious modification of our present invention. Accordingly, such alternatives, changes and modifications are to be considered as forming a part of our invention insofar as they fall within the spirit and scope of the appended claims.

INDUSTRIAL APPLICABILITY

The pouch of the present invention can contain a variety of fluids such as shampoo and conditioner, shower and shaving gels, shower and bath oil, hand and body lotion, moisturizing cream, dish-washing detergent, liquid hand soap, liquid laundry detergent and stain remover, liquid automotive products such as windshield-washer fluid, catsup and mustard, salad dressing and jelly, liquid dairy products such as milk and yogurt, and various beverages such as fruit juice, soft drinks, mineral water and the like. Further, we hereby define the term "fluid" broadly; and we, accordingly, contemplate utilizing our pouch to contain fluid-like, pourable powders such as laundry detergents, household cleaners, and the like.

We claim:

1. In a pouch sealed along peripheral edge margins, wherein the pouch defines a sealed cavity for containment of a fluid, wherein a portion of the pouch edge margin defines a sealed fluid-discharge spout in fluid communication with the cavity, wherein the fluid-discharge spout has a fluid-discharge end, and wherein another portion of the pouch edge margin defines a seam disposed between the fluid cavity and the spout, wherein the improvement comprises:

wherein the pouch is made of a molecularly-orientable polymeric film;

wherein the pouch edge margin portion which defines the fluid-discharge end of the spout is molecularly-oriented in a preselected direction;

wherein a portion of the seam defines a tear-terminating slit that is disposed transverse to the preselected direction; and wherein the pouch edge margin portion which defines the fluid-discharge end of the spout includes a tear-initiating notch oriented along the preselected direction, wherein the slit completely penetrates the polymeric film and is of a length that is effective for terminating any tear extending from the notch to the slit along the preselected direction.

2. The pouch of claim 1 wherein the slit severs an edge margin of the pouch.

3. The pouch of claim 1 wherein the slit terminates in an edge margin of the pouch.

4. The pouch of claim 1 wherein the spout, the seam and the slit are each elongated, and wherein the elongated spout includes means for controlling fluid flow therethrough.

* * * * *